US010687613B2

(12) United States Patent
Smith

(10) Patent No.: US 10,687,613 B2
(45) Date of Patent: Jun. 23, 2020

(54) ROTARY CLEANING TOOL FOR COMMODE SURFACES

(71) Applicant: Craig R. Smith, Chandler, AZ (US)

(72) Inventor: Craig R. Smith, Chandler, AZ (US)

( * ) Notice: Subject to any disclaimer, the term of this patent is extended or adjusted under 35 U.S.C. 154(b) by 0 days.

(21) Appl. No.: 15/055,558

(22) Filed: Feb. 27, 2016

(65) Prior Publication Data

US 2016/0324305 A1 Nov. 10, 2016

Related U.S. Application Data

(60) Provisional application No. 62/158,071, filed on May 7, 2015.

(51) Int. Cl.

| | |
|---|---|
| ***A46B 13/02*** | (2006.01) |
| ***B24B 37/24*** | (2012.01) |
| ***B08B 1/04*** | (2006.01) |
| ***A47K 11/10*** | (2006.01) |
| ***B08B 1/00*** | (2006.01) |

(52) U.S. Cl.

CPC ..... *A46B 13/02* (2013.01); *A47K 11/10* (2013.01); *B08B 1/04* (2013.01); *B24B 37/24* (2013.01); *B08B 1/002* (2013.01)

(58) Field of Classification Search

None

See application file for complete search history.

(56) References Cited

U.S. PATENT DOCUMENTS

| | | | | |
|---|---|---|---|---|
| 2,427,565 | A | 9/1947 | Liger | |
| 2,775,851 | A | 1/1957 | Booth | |
| 4,218,852 | A | 8/1980 | Rademacher | |
| 4,982,469 | A | 1/1991 | Nishiwaki | |
| 6,139,594 | A | 10/2000 | Kincaid et al. | |
| 6,394,887 | B1 * | 5/2002 | Edinger | B24B 23/02 451/490 |
| 8,057,281 | B2 | 11/2011 | Annen et al. | |
| 8,381,344 | B1 * | 2/2013 | Bergman | A46B 13/02 15/1.7 |
| 8,758,089 | B2 | 6/2014 | Annen et al. | |
| 2003/0207659 | A1 | 11/2003 | Annen et al. | |

(Continued)

FOREIGN PATENT DOCUMENTS

| | | | |
|---|---|---|---|
| GB | 2067935 | A | 8/1981 |
| JP | 2630791 | B2 | 7/1997 |
| JP | 2002-059369 | A | 2/2002 |

OTHER PUBLICATIONS https://www.youtube.com/watch?v=QUyvT60yTKw; Jul. 19, 2012.*

(Continued)

*Primary Examiner* — Mikhail Kornakov

*Assistant Examiner* — Pradhuman Parihar

(74) *Attorney, Agent, or Firm* — Mark V. Loen

(57) ABSTRACT

The embodied invention is an enhanced rotary brush tool that provides important cleaning on porcelain surfaces that are stained by hard water deposits. The brush tool incorporates an outer holder that includes a motor connecting end, a tapered shaft, an outer cup and shroud. A fill epoxy bonds the outer holder together with an internal strengthening rod and an abrasive pad. The overall assembly provides significant compressive strength to allow an individual to utilize pressure when scrubbing off the water hardness buildup.

4 Claims, 6 Drawing Sheets

(56) References Cited

U.S. PATENT DOCUMENTS

| | | | | |
|---|---|---|---|---|
| 2004/0117931 | A1* | 6/2004 | Washington | A46B 13/008 15/29 |
| 2005/0172428 | A1 | 8/2005 | Thysell | |
| 2007/0093181 | A1 | 4/2007 | Lugg et al. | |
| 2009/0233528 | A1 | 9/2009 | Mansfield | |
| 2010/0223874 | A1* | 9/2010 | Young | A47L 11/162 52/318 |
| 2011/0045753 | A1* | 2/2011 | Shiro | B24B 37/22 451/540 |
| 2011/0162287 | A1 | 7/2011 | Cai | |
| 2011/0197387 | A1* | 8/2011 | Nelson | B60S 1/08 15/250.361 |
| 2012/0155985 | A1* | 6/2012 | Ruckel | F16B 37/0842 411/301 |
| 2013/0059505 | A1 | 3/2013 | Bailey | |
| 2013/0090047 | A1 | 4/2013 | Bin | |
| 2013/0260656 | A1* | 10/2013 | Seth | B24B 37/26 451/527 |
| 2014/0053355 | A1* | 2/2014 | Kluge, Jr. | A46B 9/005 15/114 |
| 2014/0242893 | A1 | 8/2014 | Oehler | |
| 2014/0308884 | A1 | 10/2014 | Janssen et al. | |

OTHER PUBLICATIONS

Web Page—http://www.alibaba.com/product-detail/metal-polishing-pad_441211691.html?s=p First Viewed on Feb. 28, 2015, see attached printout of web page(s).

Web Page—http://www.amlap.com/alw/page18.html First Viewed on Feb. 26, 2015, see attached printout of web page(s).

Web Page—http://www.zoro.com/i/G1670112/?utm_source=google_shopping&utm_medium=cpc&utm_campaign=Google_Shopping_Feed&gclid=COSSidLD-8MCFciBfgodKZQAGQ First Viewed on Feb. 25, 2015, see attached printout of web page(s).

Web Page—http://www.hitechdiamond.com/Mini_Smoothing_Disc_Kit.html First Viewed on Feb. 26, 2015, see attached printout of web page(s).

Web Page—http://specialtydiamond.com/wvdgrin-secco-wet-dry-dust-free-polisher-grinder-and-shroud-cover-concretegranite-stone-.html First Viewed on Feb. 26, 2015, see attached printout of web page(s).

Web Page—http://mkdiamondproducts.shptron.com/p/pro-resin-polishing-disc-4-3000-grit First Viewed on Feb. 26, 2015, see attached printout of web page(s).

* cited by examiner

ROTARY CLEANING TOOL FOR COMMODE SURFACES

CROSS REFERENCE TO RELATED APPLICATIONS

This application claims the benefit of U.S. Provisional Patent Application No. 62/158,071, filed on May 7, 2015. The entire provisional patent application is incorporated by reference herein.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION

(1) Field of the Invention

This invention is directed to cleaning tools useful for scrubbing very hard debris from porcelain or similar surfaces, with minimal surface damage or scratching. In particular, the invention is directed toward cleaning off hardened water deposits off of vitreous china toilets (typically called porcelain).

(2) Description of Related Art

It is an observation that many city water supplies, and private well water systems, deliver hard water. Calcium, magnesium, and other hard ions are present in water at levels that are undesirable from a cleaning standpoint. Hard water is to blame for dishes with spots and residue, and bathtubs with significant film and soap scum.

Additionally, the hard water ions create unsightly and unappealing lines on the surface of porcelain commodes. Normal evaporation at the water line in a commode will leave a noticeable residue after months (or years) of use. Also, the wetting of the surface from bowl filling around the rim will leave evaporative hardness lines that allows surface buildup. The resulting hardness adheres tightly, and the surface will often turn to colors such as grey or rust. Such surface residues are difficult to remove with normal scrubbing and cleaning chemicals. The surface has the undesirable appearance of being unsanitary, even if it technically does not allow bacteria to grow.

U.S. Pat. No. 8,733,852 is a typical scrub brush that is used to clean a toilet from typical residual debris after a toilet is used. A housing provides a sanitary place to put the brush when not in use. The soft brush is generally capable of providing removal of soft debris, but the brush is far too soft to remove deposits due to hard water.

U.S. Pat. No. 4,302,350 and U.S. application Ser. No. 11/772,935 are examples of chemical attempts to inhibit residue formation or harsh chemicals to clean the surfaces. Harsh chemicals are undesirable from a customer standpoint and are generally undesirable from an environmental standpoint.

A pumice stone attached to a handle is one method used to manually abrade and remove hard water deposits. However, the manual labor used to remove deposits is significant.

Additionally, the pumice stone wears quickly and is useable for only a few times. A pumice stone is difficult to adapt to a labor saving device, such as a rotary tool, due to the uneven wear. Also, a pumice stone means that the person doing the scrubbing will get their hands wet. This is an undesirable approach.

What is needed is an affordable to satisfactorily clean a toilet bowl ring without getting hands wet, minimizes labor by use of a labor saving tool, and is capable of repeated use.

BRIEF SUMMARY OF THE INVENTION

The embodied invention is an enhanced rotary brush tool that provides important cleaning on porcelain surfaces that are stained by hard water deposits. The brush tool incorporates an outer holder that includes a motor connecting end, a tapered shaft, an outer cup and shroud. A fill epoxy bonds the outer holder together with an internal strengthening rod and an abrasive pad. The overall assembly provides significant compressive strength to allow an individual to utilize pressure when scrubbing off stains.

BRIEF DESCRIPTION OF THE SEVERAL VIEWS OF THE DRAWING(S)

DETAILED DESCRIPTION OF THE INVENTION

Figure 1:
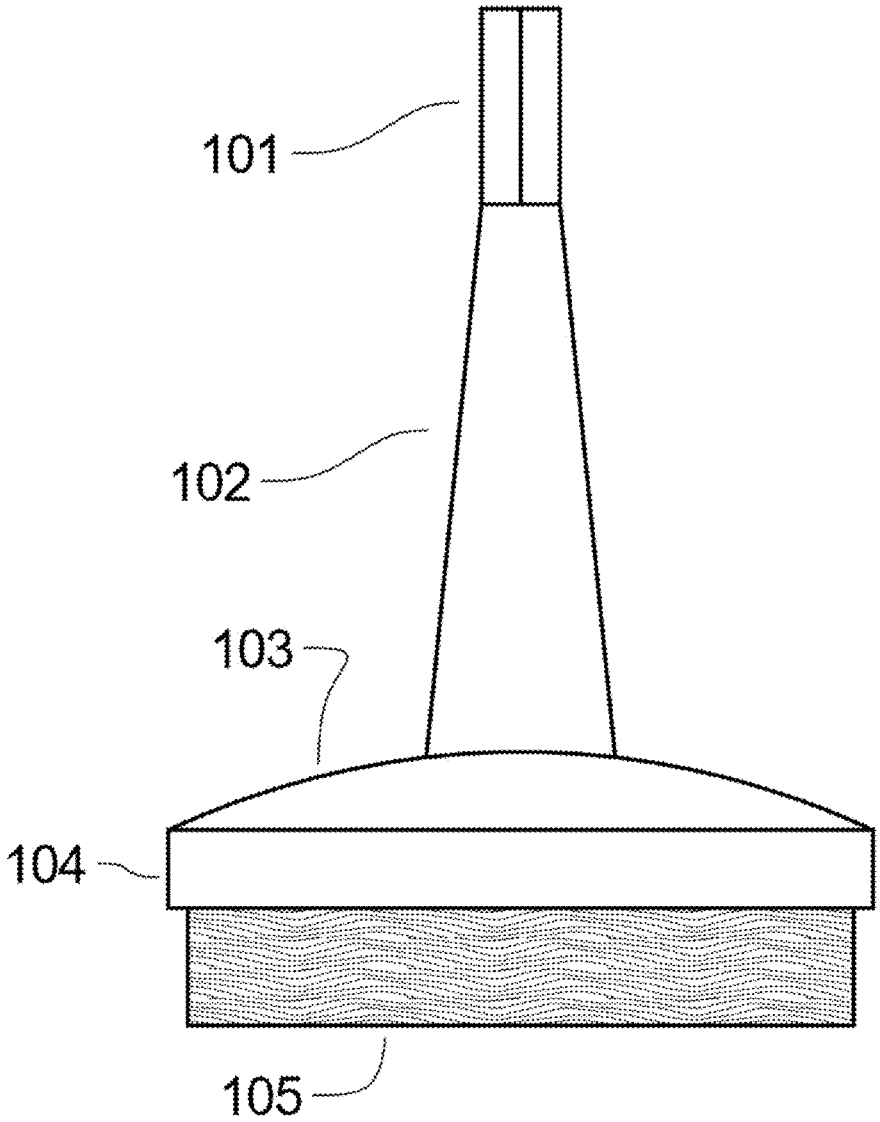
FIG. 1 is a front view of the rotary brush tool.

FIG. 1 shows a front view of the rotary brush scrubbing tool. A hex end 101 is used to connect the end of the rotary brush scrubbing tool to a motorized drill or similar piece of equipment. The hex end is rigidly connected to a tapered shaft 102, which in turn, is rigidly connected to an outer cup 103. The outer cup 103 is connected to a shroud 104 which surrounds an abrasive pad 105.

In FIG. 1, the tapered shaft and outer cup are preferably hollow and capable of receiving a filling/binding epoxy (not shown) that will be used to adhere the abrasive pad. The epoxy is preferably a two-part epoxy with an adhering strength of at least 1,500 psi.

Even though the rotary tool in FIG. 1 is described as individual parts, in production the entire part is preferably made from an injection molding machine in one piece for economic efficiency and for better connectivity without stress breakage.

The abrasive pad is preferably a Butyl pad with a bonded diamond grit paste (petroleum based) that is baked on at oven temperatures until dried to create a bond. The grit size is based on the commercial screen size. For example, a 400 diamond grit is the output from a 400 mesh commercial screening process with a nominal opening of 0.0015". In a preferred embodiment a 400 diamond grit is used. In general, a 300 or higher grit will provide the abrasion needed. Use of a diamond grit embedded into the Butyl pad provides for abrasive treatment of water spots with a diamond grit suitable for surface polishing, and also provides for minimize damage and scratching to the external glaze surface of the commode. The paste optionally includes a tin oxide (10000-12000 grit). The efficacy of the paste will last in multiple scrub events, and is preferably designed to withstand at least 30 uses in commode cleaning.

Figure 2:
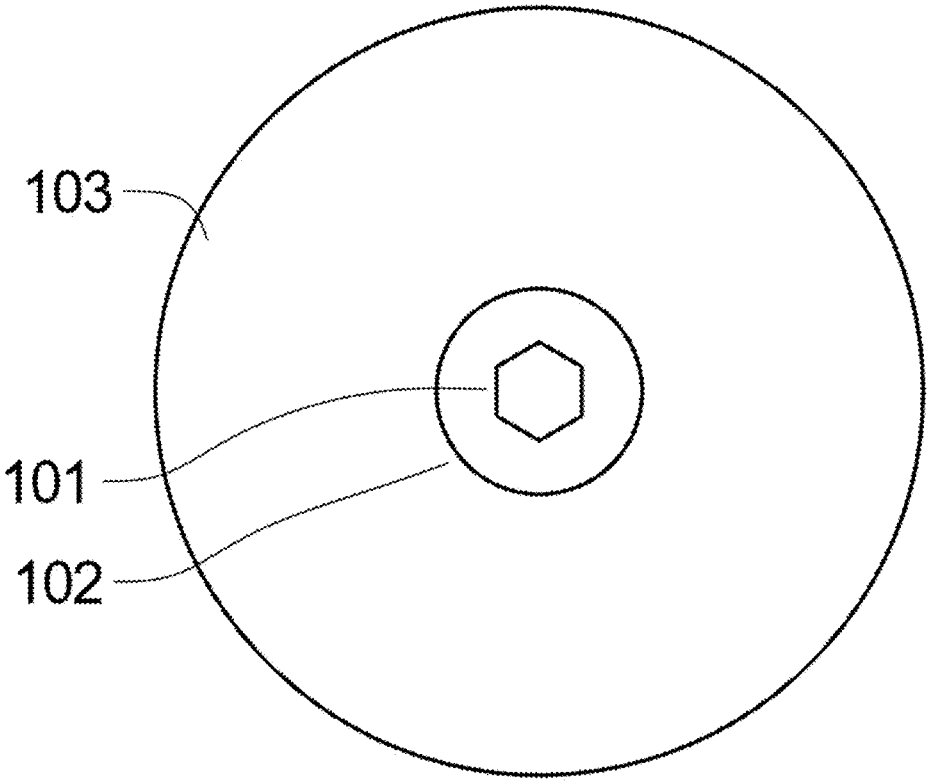
FIG. 2 shows a top view of the rotary brush tool.

FIG. 2 shows a top view of the rotary brush tool. The hex end 101 (or motor connection) is meant to be a connection to a rotary tool such as an electric drill. The hex end is alternately a square end or round end that will connect to a rotating motor fixture so that it is capable of withstanding torque without damage. To this end, the hex end 101 is solid plastic.

Figure 3:
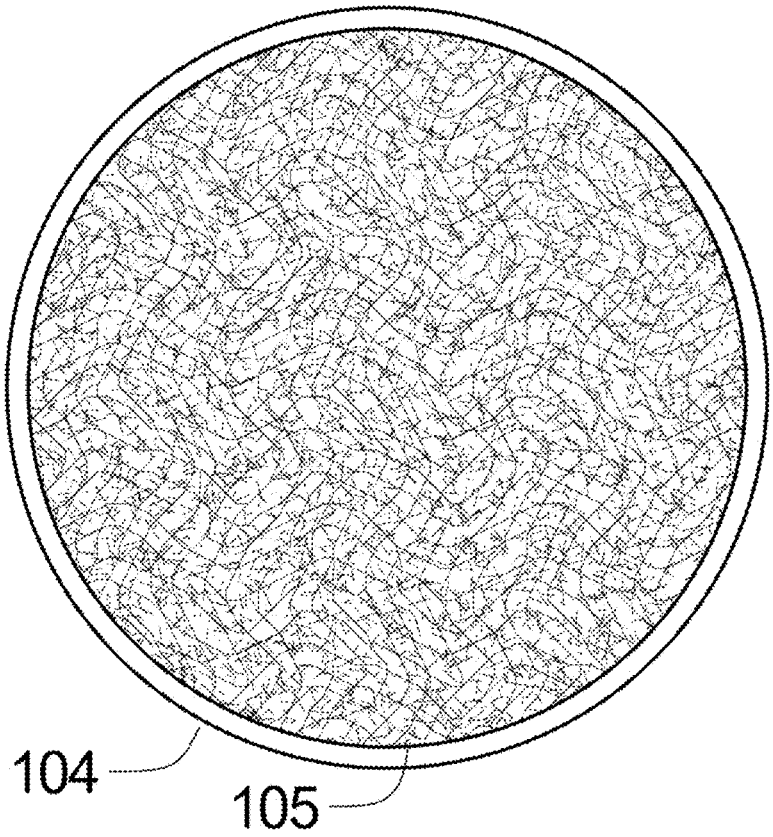
FIG. 3 shows a bottom view of the rotary brush tool.

FIG. 3 shows a bottom view of the rotary brush tool highlighting the brush pad.

Figure 4:
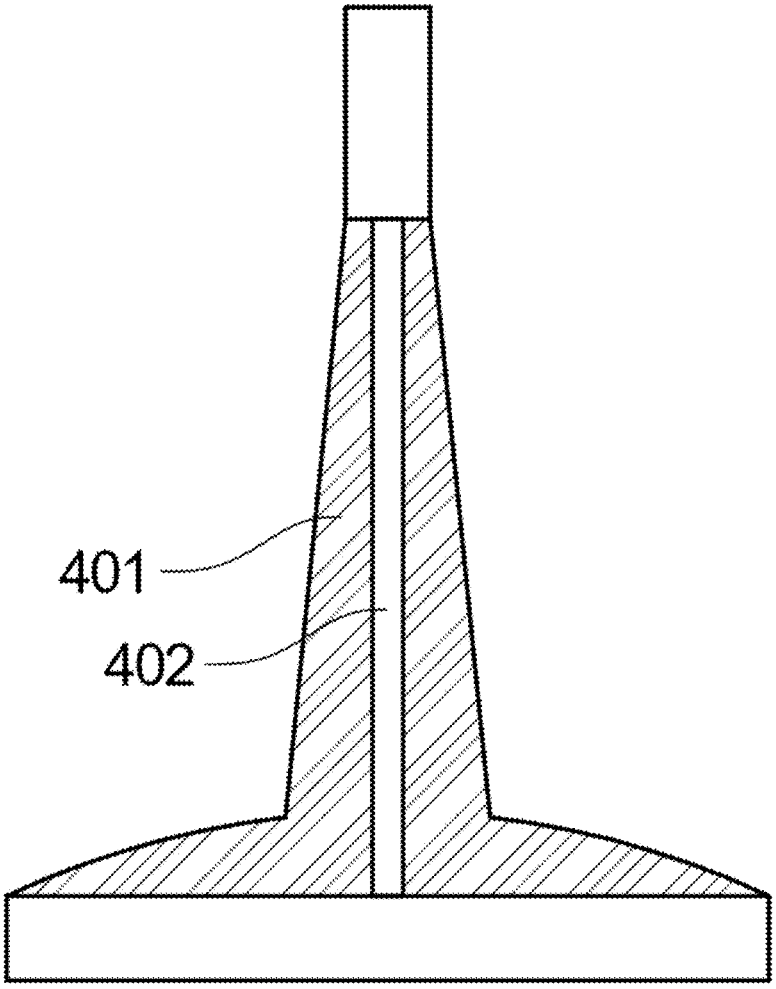
FIG. 4 is a cross section through FIG. 1 and shows the inner epoxy and internal rod used to stiffen and glue the various parts together.

FIG. 4 is a cross section through FIG. 1 and shows the inner fill epoxy 401 and internal strengthening rod 402 used to glue and stiffen the various parts together and increase the compressive strength of the rotary brush tool.

Figure 5:
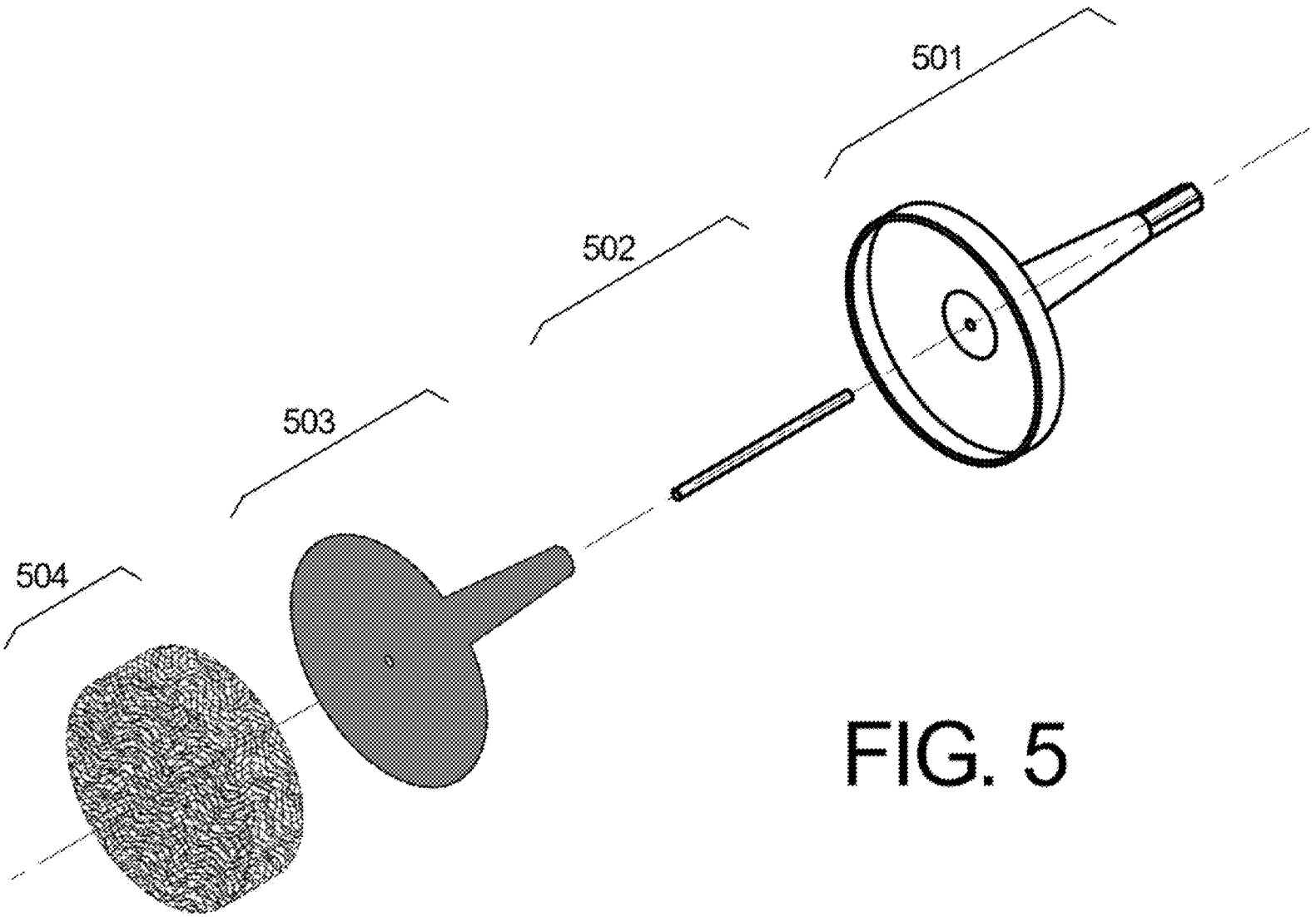
FIG. 5 is an exploded view of the rotary brush tool.
Figure 6:
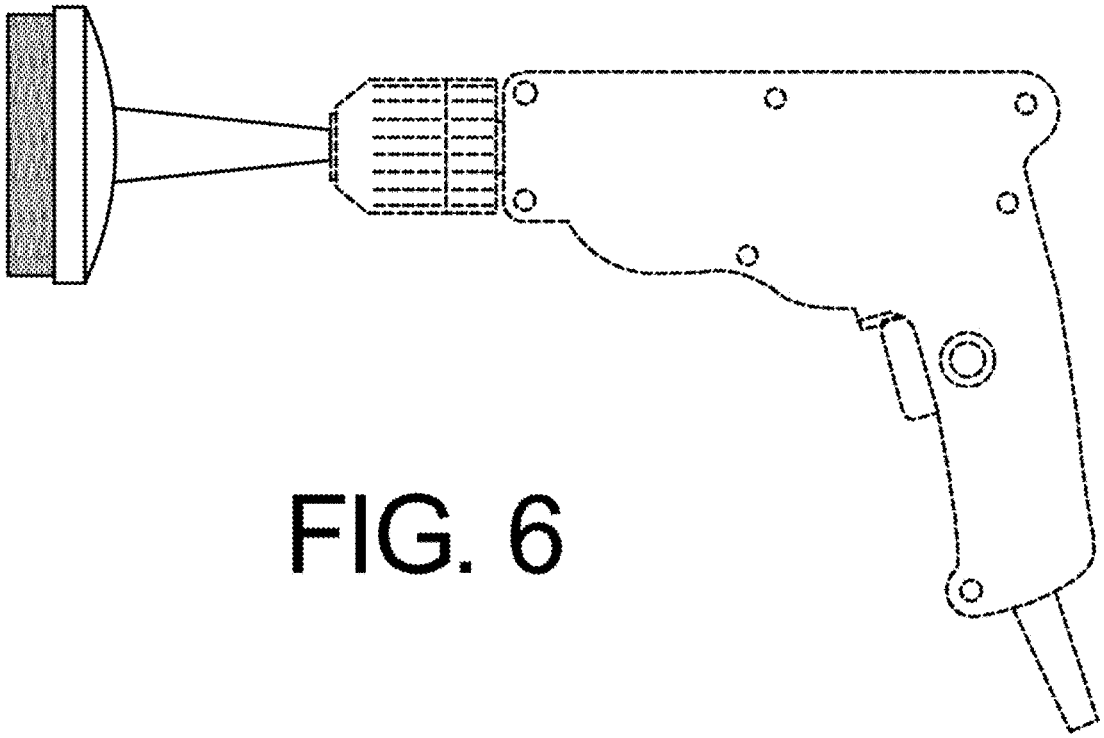
FIG. 6 is a view of the rotary brush tool when connected to the end of a rotary drill.

FIG. 5 shows an exploded view of the rotary brush tool. An outer holder 501, an internal reinforcing rod 502, a fill in epoxy compound 503 (shown in the shape in which it is formed by the gap between the outer holder and the internal reinforcing rod), and rotary brush pad 504 are illustrated in perspective view. The assembly is glued together by the epoxy compound 503 which attaches the rotary brush pad to the outer holder.

The internal reinforcing or strengthening rod is buried in the epoxy compound and is an important part of the rotary brush tool. The rod provides important stiffness and compressive strength to the assembly and prevents breakage when strong pressure is applied to the rotary brush pad when it is being used. During initial prototyping, it was found that the desired compressive strength was readily achieved with the rod present, and without it, the outer holder 501 experienced breakage in an important initial trial. In a preferred embodiment, the strengthening rod is a metal, preferably steel. In another preferred embodiment, the rod is advantageously threaded on the exterior so that the metal rod is completely and firmly encapsulated by the surrounding epoxy.

The outer holder is preferably made from plastic, ABS in particular was found to be acceptable. Other plastics with similar stress properties could also be used.

In a preferred embodiment, success in use of the rotary scrubbing brush is based rotating the brush pad with a motor and pressing the brush pad against the stained surface. The residual water in the base of the commode provides an acceptable lubrication during the cleaning and the pad will naturally touch the water during cleaning to provide lubrication. It is preferred that the application of the brush is generally applied to a water wetted surface. During the cleaning action, a small amount of the diamond paste will come out of the brush pad and is easily flushed out of the commode for environmentally safe removal. The amount of diamond paste bonded to the brush pad will dictate how long the brush pad will be effective.

The shroud is helpful in keeping the pad from excessive spraying water during use. It was noted during a trial that a shroud-less pad will spray water in an unacceptable manner when the pad touches the water in the bottom of the commode. The shroud also helps to increase edge pressure on the brush pad when tipping the rotary scrubbing brush against the stained surface. In this case, the edge area of the pad is used for cleaning. This method helps to remove water hardness from stubborn areas of the commode.

It should be emphasized that use of the rotary scrubbing tool provides improvements in the cleaning method that are harder to define. Cleaning of minor stains will take only a few minutes, and major stains should be addressable in 10-15 minutes of work. It is far easier to apply pressure and let a tool do the work than to use a manual scraping method such as a pumice stone. Also, the rotary brush scrubbing tool has a length that allows a cleaning person to keep their hands out of the commode water and eliminate the grimy feeling when cleaning the commode surfaces.

It should also be noted that the use of the rotary brush scrubbing tool is not confined to only commode surfaces, but its use is applicable to a variety of porcelain surfaces, such as are found elsewhere in a house or a place of business. In particular, such surfaces include a commode surface, a bathtub surface, a sink, or a shower surface.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. A rotary brush scrubbing tool for removing water hardness buildup on a porcelain surface comprising:

A) an elongated outer holder with a center line aligned in parallel with a rotating axis, wherein said elongated outer holder further comprises the following items connected in sequence:
   1) a motor connecting end,
   2) a hollowed tapered shaft,
   3) an outer cup, and
   4) a water spray shroud shaped as a ring, B) a compression strengthening metal rod inserted into said hollowed tapered shaft, wherein an elongated axis of said compression strengthening metal rod is substantially aligned with said center line and extends-through said outer cup, C) a fill epoxy that fills a space between said compression strengthening metal rod and said outer cup, and additionally fills a space between said compression strengthening metal rod and said hollowed tapered shaft, D) a disk shaped abrasive pad additionally bonded to said fill epoxy and inserted into said abrasive pad shroud, wherein a thickness direction of said disk shaped abrasive pad is substantially aligned with said rotating axis, E) wherein said disk shaped abrasive pad is made from butyl and incorporates a predetermined diamond grit size that is bonded to said disk shaped abrasive pad, F) wherein a flat surface of said disk shaped abrasive pad is oriented perpendicular to said rotating axis, G) wherein said water spray shroud partly encompasses a side surface of said disk shaped abrasive pad, and H) whereby the function of removing said water hardness from said porcelain surface when pressing and rotating said rotary brush scrubbing tool against said water hardness is added.

2. The rotary brush scrubbing tool according to claim 1, wherein said hollowed tapered shaft having a tapered angle of about 12 degrees.

3. A method for removing water hardness buildup on a porcelain surface comprising:

A) providing a rotary brush scrubbing tool comprising:
   1) an outer holder with a center line aligned in parallel with a rotating axis, wherein said outer holder further comprises the following items connected in sequence:

a) a motor connecting end,
b) a hollowed tapered shaft,
c) an outer cup, and
d) a water spray shroud shaped as a ring, 2) a compressive strengthening metal rod inserted into said hollowed tapered shaft and extending through said outer cup, wherein an elongated axis of said compressive strengthening metal rod is substantially aligned to said rotating axis, 3) a fill epoxy that fills a space between said strengthening rod and said outer cup, and additionally fills a space between said compressive strengthening metal rod and said hollowed tapered shaft, 4) a disk shaped abrasive pad additionally bonded to said fill epoxy and inserted into said abrasive pad shroud, wherein a thickness direction of said disk shaped abrasive pad is substantially aligned with said rotating axis, 5) wherein said disk shaped abrasive pad is made from butyl and incorporates a predetermined diamond grit size that is bonded to said disk shaped abrasive pad, 6) wherein a flat surface of said disk shaped abrasive pad is oriented perpendicular to said rotating axis, and 7) wherein said water spray shroud partly encompasses a side surface of said disk shaped abrasive pad, B) connecting said rotary brush scrubbing tool to a motor, C) powering said motor, D) applying pressure between said rotary brush scrubbing tool and said water hardness buildup, E) lubricating said water hardness buildup with water when applying said rotary brush scrubbing tool to said water hardness buildup, and F) whereby the function of removing said water hardness from said porcelain surface is added.

4. The method according to claim 3, wherein said hollowed tapered shaft having a tapered angle of about 12 degrees.

* * * * *